United States Patent [19]

Cheng

[11] Patent Number: 4,694,501

[45] Date of Patent: Sep. 15, 1987

[54] NONSYNCHRONOUS INDEPENDENT SIDE BAND AM STEREO DECODER

[75] Inventor: Fred T. Cheng, Cupertino, Calif.

[73] Assignee: National Semiconductor Corporation, Santa Clara, Calif.

[21] Appl. No.: 680,026

[22] Filed: Dec. 10, 1984

[51] Int. Cl.[4] ..... H04H 5/00

[52] U.S. Cl. ..... 381/15

[58] Field of Search ..... 381/2, 15, 16; 455/205, 455/206; 329/110

[56] References Cited

U.S. PATENT DOCUMENTS

| | | | |
|---|---|---|---|
| 3,218,393 | 11/1965 | Kahn | 179/15 |
| 3,908,090 | 9/1975 | Kahn | 179/15 |
| 3,944,749 | 3/1976 | Kahn | 179/15 |
| 4,018,994 | 4/1977 | Kahn | 179/15 |
| 4,349,696 | 9/1982 | Akitake et al. | 381/15 |
| 4,362,999 | 12/1982 | Sauer | 329/103 |
| 4,375,580 | 3/1983 | Sauer | 381/15 |
| 4,377,725 | 3/1983 | Hershberger | 381/15 |

OTHER PUBLICATIONS

"AM Stereo" by National Semiconductor Corp.

"Linear Application Update" by National Semiconductor Corp.

"Kahn/Hazeltine Independent Side Band (ISB) AM Stereo System" by Hazeltine Research, Inc.

"LM1981 AM Stereo Decoder" by National Semiconductor Corp.

"A Stereophonic System for Amplitude Modulated Broadcast Stations" by Leonard Kahn, published in IEEE Transactions on Broadcasting—1981.

*Primary Examiner*—Forester W. Isen

[57] ABSTRACT

An AM stereo receiver uses an AM detector (208) and an asynchronous PM detector (206) to decode AM stereo signals. The AM stereo broadcast signal has a carrier signal phase modulated with a modified phase shifted left channel minus right channel (L−R) audio signal, which is then amplitude modulated with a phase shifted left channel plus right channel (L+R) audio signal.

The AM detector (208) within the receiver decodes the phase shifted L+R signal, while the PM detector 206 within the receiver decodes the modified phase shifted L−R signal. A phase shifter (214) restores the L+R and L−R signals to their proper phase relationship. A matrix circuit (228) regenerates the left and right channel signals from the L+R and L−R signals.

7 Claims, 8 Drawing Figures

NONSYNCHRONOUS INDEPENDENT SIDE BAND AM STEREO DECODER

BACKGROUND OF THE INVENTION

This invention relates to radio receivers, and more particularly, to a radio receiver capable of decoding a stereo transmission utilizing amplitude modulation.

Stereo broadcasting utilizing frequency modulation has been widely used for decades. In FM stereo broadcasting, a radio frequency carrier is frequency modulated with baseband information containing the left and the right (L+R) audio signals and by a subcarrier having a frequency well above the range of human hearing. This subcarrier is itself modulated by the difference between the left channel audio signal and the right channel audio signal (L−R). When the stereo broadcast is decoded, the L+R and L−R signals are recovered. By adding the L−R signal to the R+R signal, the left channel signal is obtained. Similarly, by subtracting the L−R signal from the L+R signal, the right channel signal is obtained.

There are several inherent disadvantages in FM stereo broadcasting. First, frequency modulation is employed which necessitates more complex transmitting and receiving equipment than is required for AM transmission and reception. Secondly, because the L−R subcarrier is required, a relatively large bandwidth FM signal must be transmitted, thereby minimizing the number of stations which may broadcast in the FM broadcast band. Thirdly, FM broadcasting is generally confined to the VHF regions and above, thereby minimizing the distance over which FM broadcasts may be received. Also, FM broadcasts are even more difficult to receive in automobiles due to the physical limitations placed on automobile radio antennas, as well as due to the terrain and similar effects provided by high-rise office buildings located in major cities.

For at least these reasons, in recent years much attention has been placed on the possibility of broadcasting stereo transmissions utilizing amplitude modulation within the standard AM broadcast band which extends from 550 Khz to 1610 Khz. A number of AM stereo systems have been proposed. It is highly desirable to broadcast AM stereo utilizing a system which allows standard monaural AM radio receivers to monaurally receive AM stereo broadcasts.

One such AM stereo system that has been proposed and is gaining widespread acceptance is the so-called "Kahn system". Various versions of the Kahn system are described, for example, in U.S. Pat. Nos. 3,218,393; 3,908,090; and 4,018,994 issued to Kahn, and which are hereby incorporated by reference. Mr. Kahn also described the Kahn system in an article entitled "A Stereophonic System for Amplitude-Modulated Broadcast Stations", *IEEE Transactions on Broadcasting*, Volume BC-17, No. 2, June 1971, pages 50–555, which is hereby incorporated by reference. The Kahn system is an AM stereo system which is compatible with existing AM broadcast transmission equipment and receivers. The transmitter provides a signal having an envelope which is modulated by the L+R signal. Thus, a standard monaural AM receiver can receive AM stereo transmissions broadcasted in accordance with the Kahn system and provide an audio output signal including left channel plus right channel information (L+R).

The L−R signal is used to phase modulate the carrier. A receiver constructed in accordance with the Kahn system decodes both the L+R signal and L−R signal and derives therefrom the left channel signal and the right channel signal.

FIG. 1 illustrates a transmitter 10 constructed in accordance with the Kahn system, which includes an input terminal 12 for receiving a left channel signal (L) and an input terminal 14 for receiving a right channel signal (R). Terminals 12 and 14 are coupled to a matrix circuit 16 which includes an adder **16*a* and a subtractor 16*b*. Adder 16*a* adds the left signal to the right signal and provides the resulting L+R signal on an output lead 18*a*. Similarly, subtractor 16*b* subtracts the right channel audio signal from the left channel audio signal and provides the resulting L−R signal on an output lead 18*b***.

The signals presented on output leads **18*a* and 18*b* are phase shifted by a 90° difference network 20. Specifically, a first phase shifter 20*a* shifts the phase of the L+R signal by −45°, and places the resulting signal on an output lead 22*a*. Similarly, a second phase shifter 20*b* phase shifts the L−R signal by +45° and places the resulting signal on an output lead 22*b***.

Output lead **22*b*, terminal 12, and terminal 14 are coupled to a second harmonic component circuit 24, the output lead of which is coupled to a summing circuit 26. Summing circuit 26 and circuit 24 modify the L−R signal to eliminate various undesired spectral components, and provide the modified L−R signal on an output terminal 28. This modified L−R signal is presented to a phase modulator 30 which uses the modified L−R signal to phase modulate a carrier signal provided by an oscillator 32. The output lead of phase modulator 30 is coupled to an amplitude modulator 34 which amplitude modulates the phase modulated carrier. Amplitude modulator 34 thus produces a signal having an envelope indicative of L+R information, while the carrier is phase modulated with a modified L−R signal. Since the envelope includes L+R information, a conventional AM receiver can be used to decode a monaural AM signal from the broadcast. Since L−R information is phase-encoded onto the carrier, a Kahn-type receiver can decode the L−R signal and derive therefrom separate left and right channel signals. The output lead of amplitude modulator 34 is presented to an RF power circuit 36 which translates the output of modulator 34** to a high power RF signal.

Transmitter 10 of FIG. 1 is described in greater detail in *ISB AM Stereo Receiver Practices*, published by Hazeltine Research, Inc., on Apr. 15, 1982, which is hereby incorporated by reference.

A receiver to be used in conjunction with transmitter 10 is also described in *ISB AM Stereo Receiver Practices*. The described receiver uses a pair of phase-locked loops to generate a reference IF signal. This reference IF signal is used to phase demodulate the received signal. Phase-locked loops employed in phase demodulation circuits generate harmonic interference signals, which causes noise and interference problems in AM stereo receivers.

SUMMARY

A receiver constructed in accordance with the present invention incudes a terminal for receiving a stereo AM signal encoded in accordance with the Kahn AM stereo system described above. The terminal is coupled to an asynchronous phase modulation (PM) detector and a conventional amplitude modulation (AM) detector.

The output signal from the AM detector is passed through a buffer amplifier and a phase shifter which shifts the phase of the amplifier output signal +45°. The resulting phase shifted signal equals the original L+R signal.

The PM detector is used to detect the modified phase-shifted L−R signal which the Kahn transmitter uses to phase modulate the carrier signal. The PM detector includes an LC network coupled to the PM detector input terminal and a multiplier coupled to the PM detector input terminal and the LC network. The multiplier provides an output signal indicative of the difference in frequency between the phase modulated signal and the carrier frequency of the phase modulated signal. The multiplier output signal is then integrated to reconstruct the phase-encoded modified L−R signal, which is then converted to the original L−R signal. In this way, the use of phase-locked loops to generate a reference signal and their attendant noise problems is obviated. The L−R and L+R signals are then presented to a matrix circuit which in turn provides left and right channel audio signals.

It is noted that transmitters constructed in accordance with the Kahn system and receivers constructed in accordance with this invention are adapted to transmit and receive audio information, respectively. However, it is possible to use the receiver disclosed herein to receive information other than audio signals. For example, the receiver could decode signals corresponding to digital data, i.e., a left channel digital data signal for use in remote telemetry and the like.

DETAILED DESCRIPTION

Figure 1:
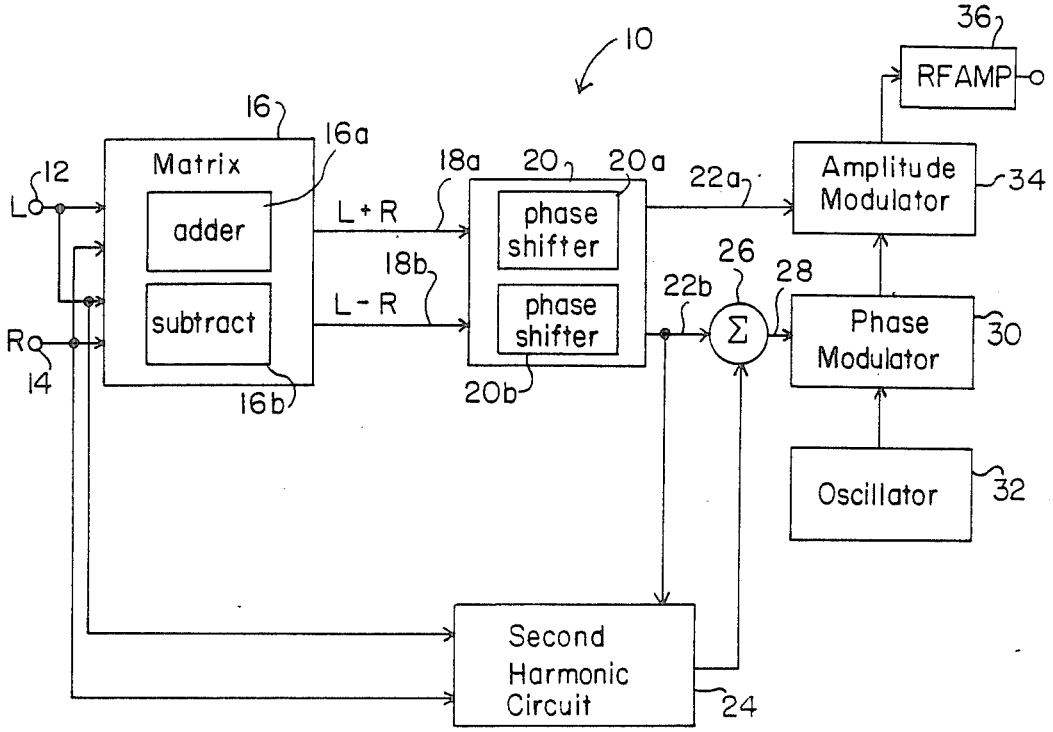
FIG. 1 (PRIOR ART)
FIG. 1 is a block diagram of an AM stereo transmitter constructed in accordance with the prior art.
Figure 2:
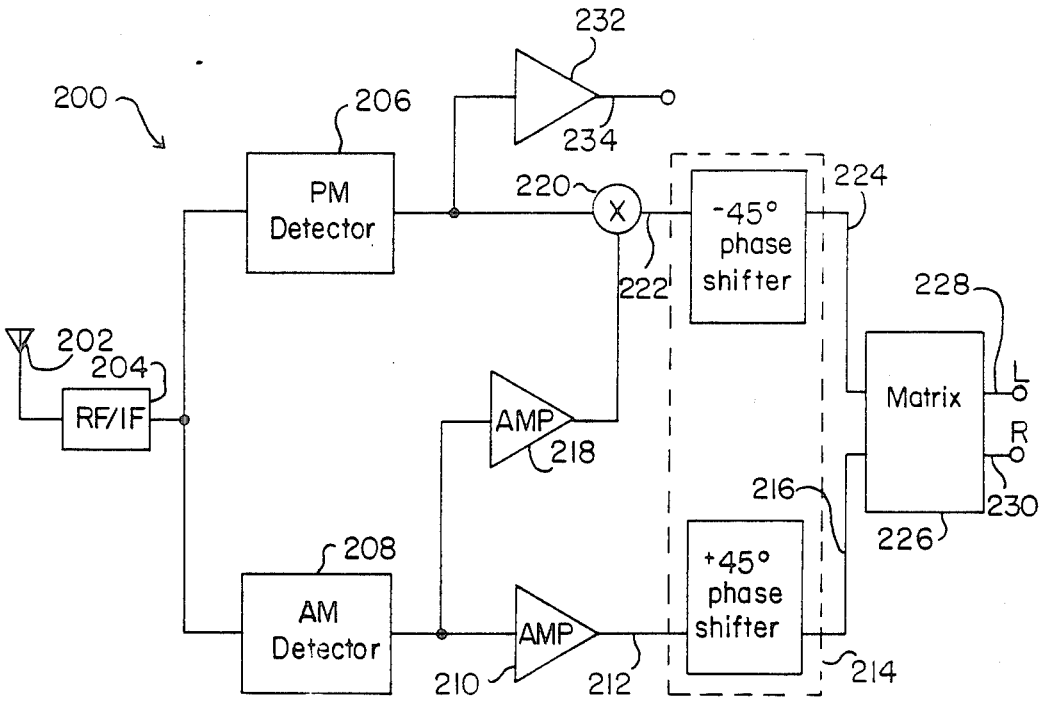
FIG. 2 is a block diagram of an AM stereo receiver constructed in accordance with one embodiment of this invention.

Referring to FIG. 2, a block diagram illustrates a receiver 200 for decoding left and right channel audio signals broadcast from an AM stereo transmitter in accordance with the above-described Kahn broadcasting technique.

Receiver 200 includes a conventional antenna 202 coupled to a conventional RF/IF circuit 204. RF/IF circuit 204 receives a radio frequency RF AM stereo signal from antenna 202 and translates the RF signal to an intermediate frequency (IF) signal, so the IF stages can operate efficiently at a fixed frequency regardless of the frequency of the RF signal received. The IF AM stereo signal typically has a carrier frequency of 455 KHz. RF/IF circuit 204 is coupled to an asynchronous phase modulation detector 206 and a conventional amplitude modulation (envelope) detector 208.

As described above, the envelope of the received information corresponds to L+R information shifted by −45°. AM detector 208 thus produces an output signal equal to the L+R signal shifted by −45° plus a DC component. The output signal from detector 208 is presented to an amplifier 210 which removes the DC component, and presents the shifted L+R signal to an input terminal 212 of a phase shifter 214. Phase shifter 214 receives the signal present on input terminal 212 and shifts it by +45°. Thus, the L+R signal appears on an output lead 216 of phase shifter 214.

The output lead of AM detector 208 is also coupled to an amplifier 218, which provides an output signal equal to the DC component plus $\frac{1}{2}$ (L+R) shifted by −45°. This DC component is equal to the automatic gain control (AGC) voltage generated by the AM receiver.

Phase modulation detector 206 decodes the phase-encoded modified L−R signal. The signal equation for the Kahn AM stereo phase-encoded signal approximates $$\frac{(L-R)e^{j\pi/4}}{V+.5\,(L+R)e^{-j\pi/4}-.5\,[(L+R)e^{-j\pi/4}]^2} \tag{1}$$

which in turn approximates $$\frac{(L-R)e^{j\pi/4}}{V+.5\,(L+R)e^{-j\pi/4}} \tag{2}$$

where V is the DC voltage equal to the AGC voltage. The denominator of this equation represents a distortion term.

By multiplying the output signal from detector 206 by the output signal from filter 218, via a multiplier 220, one obtains $$\frac{(L-R)e^{j\pi/4}}{V+.5\,(L+R)e^{-j\pi/4}}\times[V+.5\,(L+Re^{-j\pi/4})]=(L-R)e^{j\pi/4} \tag{3}$$

or the L−R signal phase shifted by +45° with the distortion term substantially eliminated. The output signal from multiplier 220 is coupled to an input lead 222 of phase shifter 214 which shifts the signal present on input lead 222 by −45° and places the resulting L−R signal on an output lead 224.

The regenerated L+R and L−R signals are then presented to a matrix circuit 226 which regenerates therefrom the left channel audio signal and the right channel audio signal on output leads 228 and 230, respectively. Specifically, matrix circuit 226 adds the L+R signal to the L+R signal to obtain a signal equal to 2L. This signal is placed on output lead 228. In addition, the L−R signal is subtracted from the L+R signal, with the resulting signal 2R being placed on output lead 230. Thus, receiver 200 receives an AM stereo signal encoded with Kahn's technique and generates therefrom left and right channel signals.

The Kahn system also envisions phase encoding an infrasonic pilot signal on top of the modified L−R signal. (Infrasonic signals are signals having a frequency too low to be heard—typically about 15 HZ). Thus, an amplifier 232 is coupled to PM detector 206, which provides a signal on an output lead 234 indicative of the presence of the infrasonic pilot signal. This pilot signal is used to indicate whether the broadcast station is transmitting in AM stereo or AM monaural.

Figure 3:
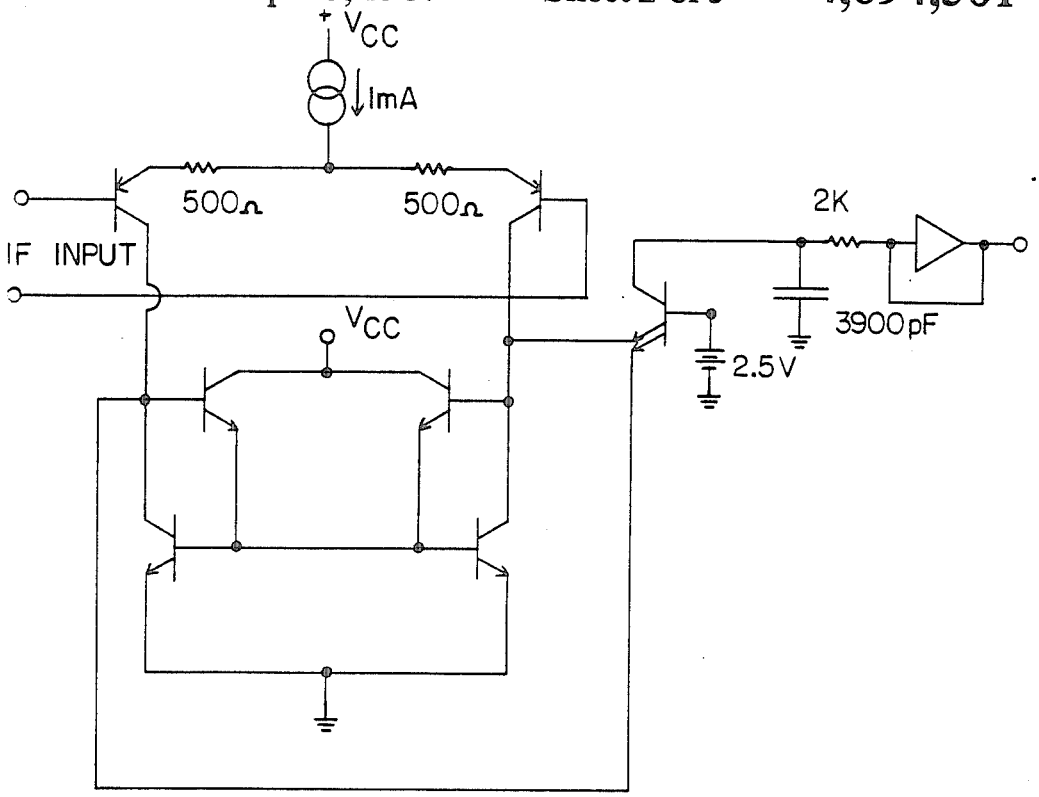
FIG. 3 is a schematic diagram of one embodiment of an AM detector circuit for use in conjunction with the circuit of FIG. 2.

FIG. 3 is a schematic diagram of one embodiment of an AM detector that can be used as AM detector 208 of FIG. 2. This AM detector is more fully described in Linear Application Update CLAU (Edition B) entitled AM Stereo, published by National Semiconductor. In addition, other conventional AM detectors could be used as well.

Figure 4:
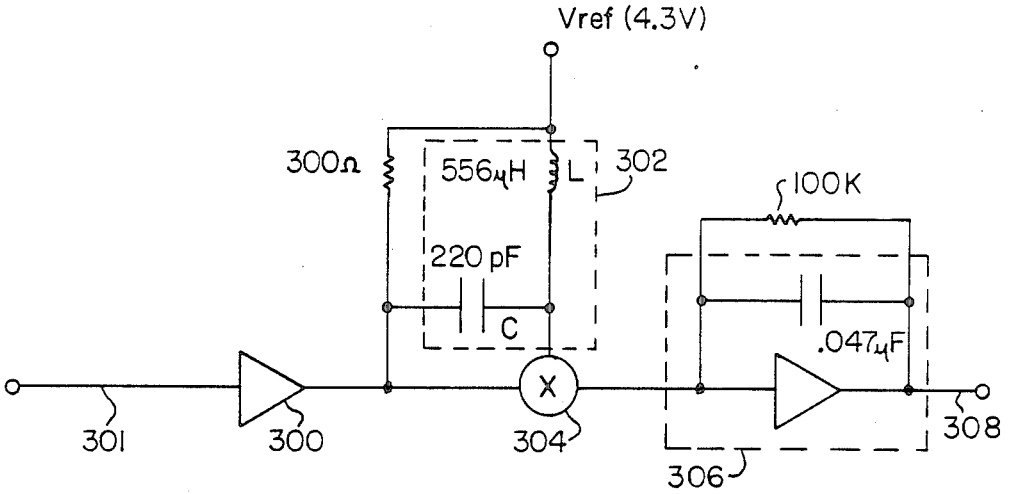
FIG. 4 is a schematic diagram of one embodiment of a PM detector for use in conjunction with the circuit of FIG. 2.

FIG. 4 is a schematic diagram of one embodiment of a PM detector that can be used as PM detector 206 of FIG. 2. This PM detector includes an input terminal 301 coupled to a limiter circuit 300, which in turn is coupled to an LC resonant circuit 302 which resonates at 455 KHz. 455 KHz is the IF signal frequency commonly used in the AM receiver manufacturing industry. Both LC circuit 302 and the output lead from limiter circuit 300 are coupled to a multiplier 304, which produces an output signal responsive to a frequency deviation in the carrier signal. The output signal from multiplier 304 is integrated by an integrator 306, which thus produces an output signal on output lead 308 responsive to the phase deviation in the carrier signal.

ALTERNATIVE EMBODIMENT

At this time, there have been a variety of other proposed AM stereo systems in addition to the Kahn system. One such system was proposed by Magnavox. As is the case with the Kahn system, there has been a considerable amount of literature regarding proposed transmitters and receivers of the Magnavox system. The above-mentioned publication, "AM Stereo," describes a circuit for decoding Magnavox AM stereo signals using device model number LM1981N, manufactured by National Semiconductor. The LM1981N integrated circuit contains some functional blocks that are useful for constructing a receiver compatible with the Kahn system. A description of the LM1981N is provided in a data sheet entitled "LM1981 AM Stereo Decoder" published by National Semiconductor. The design for this circuit includes a matrix circuit similar to matrix circuit 226 for deriving the left and right channel signals from L+R and L−R signals. Unfortunately, since the Magnavox system does not require shifting the phase of the L+R and the L−R signals, there is no allowance for a phase shifter between the AM detector output lead and the matrix circuit, or a phase shifter between the PM detector output lead and the matrix circuit.

Figure 5:
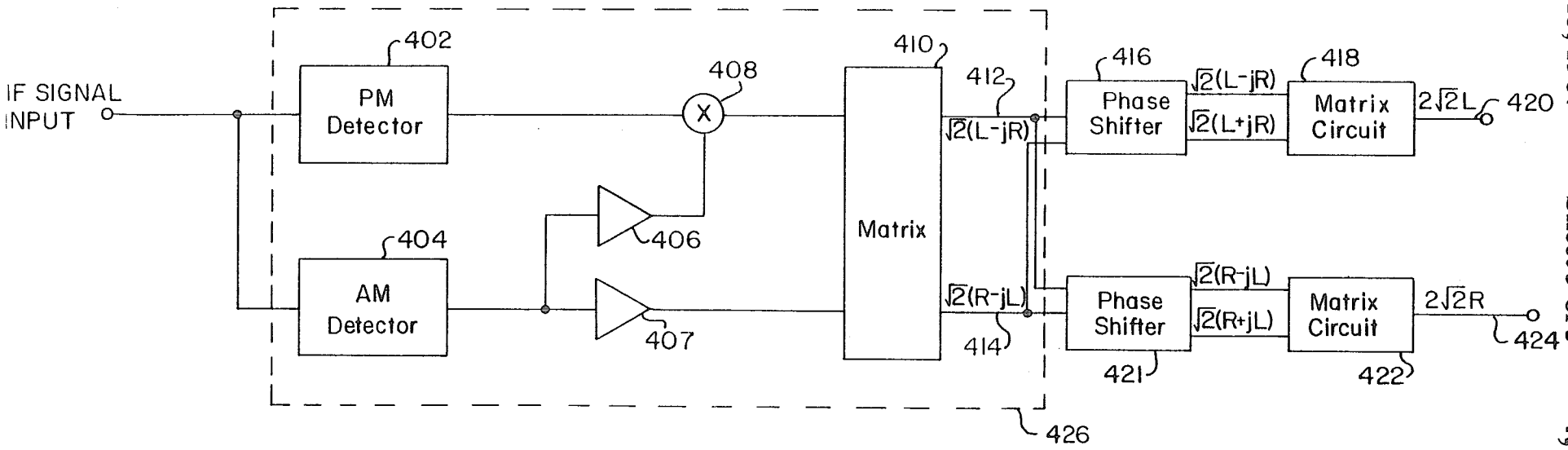
FIG. 5 is a block diagram of a second embodiment of this invention.
Figure 6:
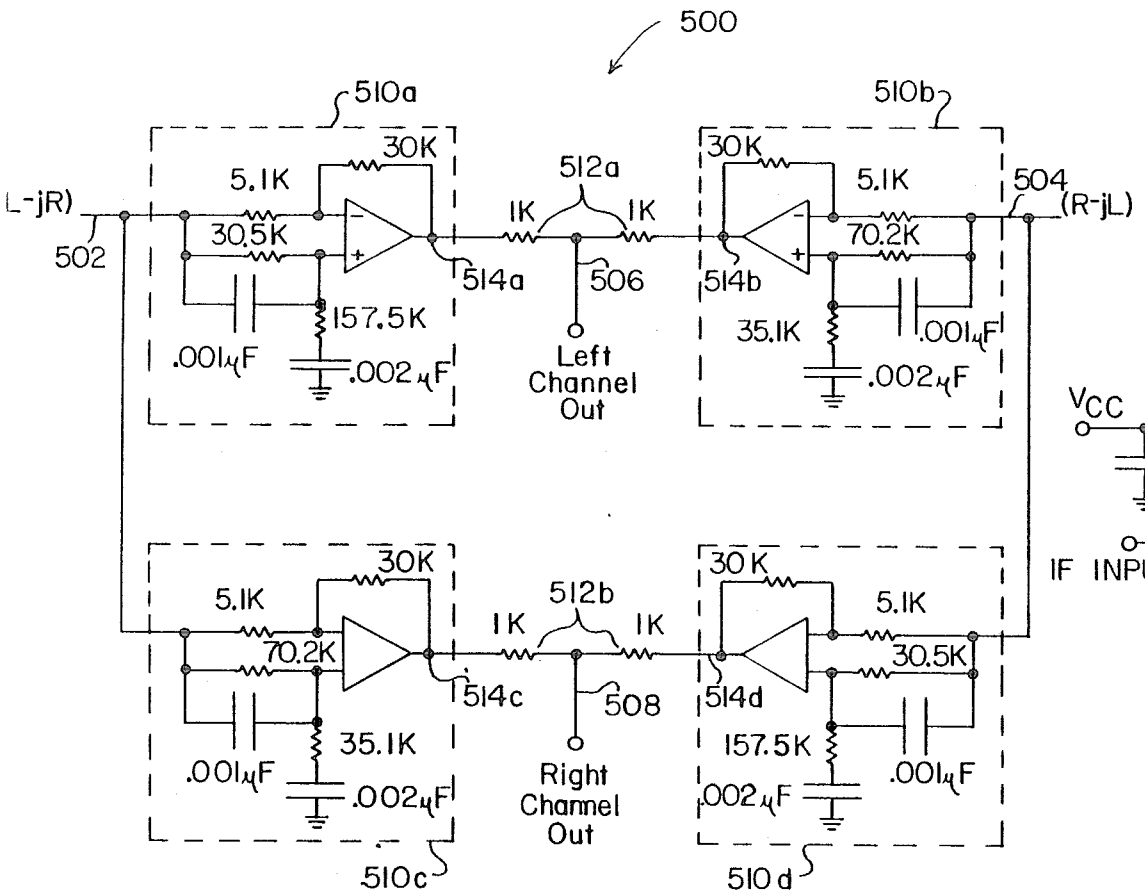
FIG. 6 illustrates one embodiment of a pair of phase shifters for use with the circuit of FIG. 5.
Figure 8:
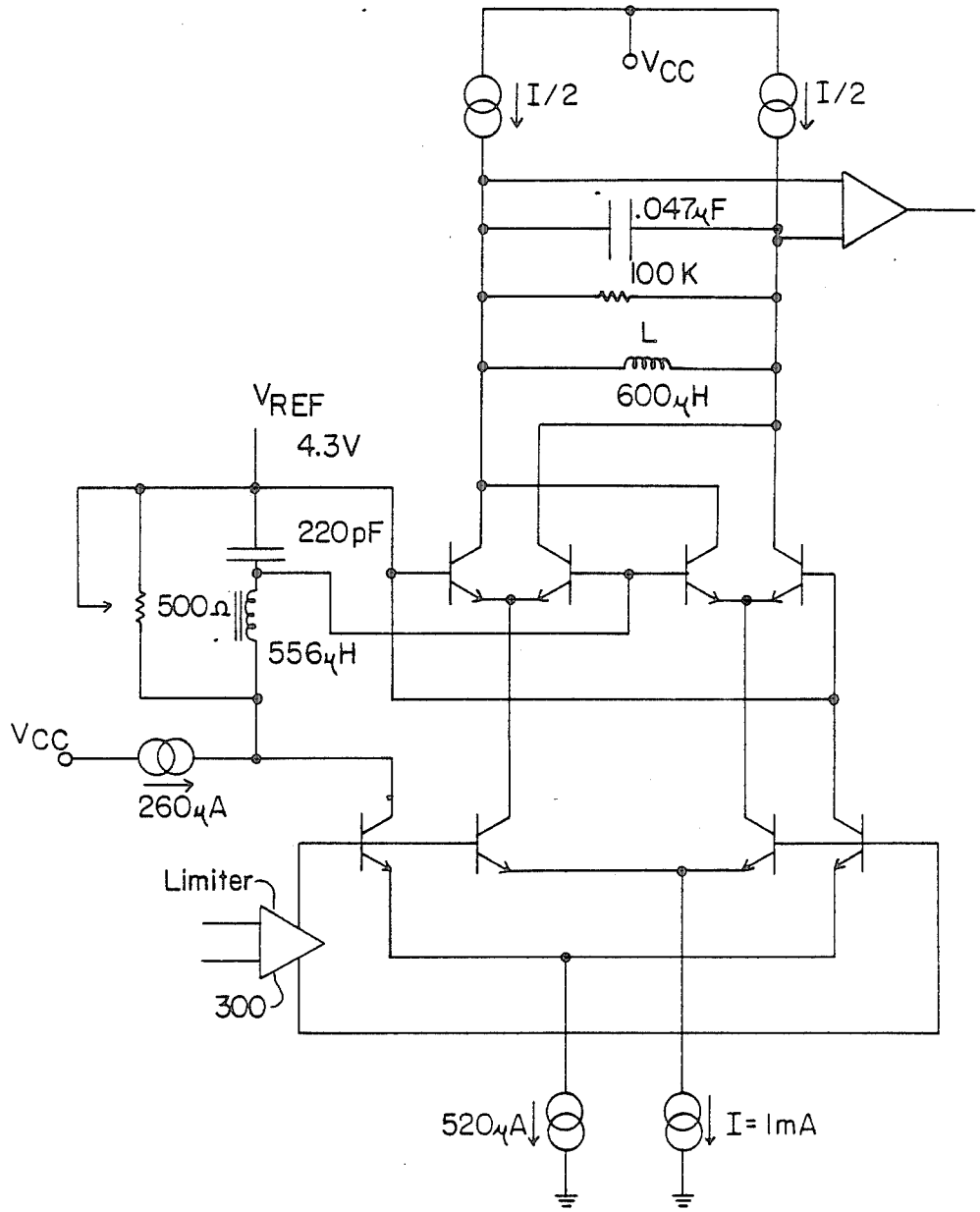
FIG. 8 is a detailed schematic diagram of a phase demodulator that can be used in the circuit of FIG. 2.

Accordingly, a second embodiment of an AM stereo receiver constructed in accordance with the present invention is illustrated in FIG. 5, which includes a PM detector 402 and an AM detector 404 for generating the phase shifted L−R and L+R signals. PM and AM detectors 402 and 404 are identical to PM detectors 206 and 208 in FIG. 3. Also included in FIG. 6 is an amplifier 406, an amplifier 407, and a multiplier 408 serving the same function as amplifier 218, amplifier 210, and multiplier 220, respectively, of FIG. 2. However, the output signal from multiplier 408 and amplifier 407 are presented directly to a matrix circuit 410. Matrix circuit 410 is identical to matrix circuit 226, but because it receives the phase shifted L−R and L+R signals, a first matrix output lead 412 provides a signal equal to 2(L−jR), and a second matrix output lead 414 provides a signal equal to 2(R−jL), where j is the imaginary number.

This can be demonstrated as follows. L−R shifted by 45° equals L Cos 45°+Lj Sin 45°−R Cos 45°−Rj Sin 45°. That plus L+R shifted by −45° equals $$L \cos 45° + Lj \sin 45° - R \cos 45° - Rj \sin 45° + \quad (4)$$

$$L \cos(-45°) + Lj \sin(-45°) + R \cos(-45°) + Rj \sin(-45°) =$$

$$2\,L \cos 45° - 2\,Rj \sin 45° = \sqrt{2}\,(L - jR),$$

which is the waveform of the signal on matrix output lead 412.

The calculation of the signal on output lead 414 is similar. The equation for the signal on output lead 414 is $$L \cos(-45°) + Lj \sin(-45°) + R \cos(-45°) + Rj \sin(-45°) - \quad (5)$$

$$[L \cos 45° + Lj \sin 45° - R \cos 45° - Rj \sin 45°] =$$

$$-2jL \sin 45° + 2R \cos 45° = \sqrt{2}\,(R - jL).$$

The signals on output leads 412 and 414 are presented to a first 90° phase shifter 416, which shifts the phase of the R−jL signal (from output lead 414) by 90° relative to the L−jR signal, thereby providing a $\sqrt{2}$(L−jR) signal (from output lead 412) and a $\sqrt{2}$j(R−jL) signal. $\sqrt{2}$j(R−jL) equals $\sqrt{2}$(L+jR).

A matrix circuit 418 adds the $\sqrt{2}$(L+jR) plus the $\sqrt{2}$(L−jR) signal and provides an output signal equal to 2 $\sqrt{2}$L on an output lead 420. Thus, a signal proportional to the original left channel signal is provided on output lead 420. Similarly, a 90° phase shifter 421 shifts the phase of the L−jR signal provided by matrix circuit 410 by 90°, providing an R+jL signal. The R+jL signal is added to an R−jL signal by a matrix circuit 422, which provides the resulting 2 $\sqrt{2}$R signal on output lead 424. Thus, the circuit of FIG. 6 provides a reconstructed left and right channel signal.

FIG. 6 is a detailed schematic diagram of one embodiment of a pair of phase shifters and matrix circuit for recovering the left and right channel signals from matrix circuit 410. The circuit 500 of FIG. 6 includes an input lead 502 which is coupled to lead 412 (FIG. 5) to receive the L−jR signal and an input lead 504, which is coupled to lead 414 (also FIG. 5).

A phase shifter 510*a* and a phase shifter 510*b* generate phase shifted L−jR and R−jL signals on a pair of nodes 514*a* and 514*b* respectively such that the shifted R−jL signal is shifted 90° with respect to the shifted L−jR signal. The shifted R−jL (equivalent to L+jR) and L−jR signals are added via a voltage divider 512*a* to produce the left channel signal an output terminal 506.

Similarly, a phase shifter 510*c* and a phase shifter 510*d* generate phase shifted R−jL and L−jR signals on a pair of nodes 514*c* and 514*d* respectively such that the shifted L−jR signals is shifted 90° with respect to the shifted R−jL signal. The shifted L−jR (equivalent to R+jL) and R−jL signals are added via a voltage divider 512*b* to produce the right channel signal on output terminal 508.

Figure 7:
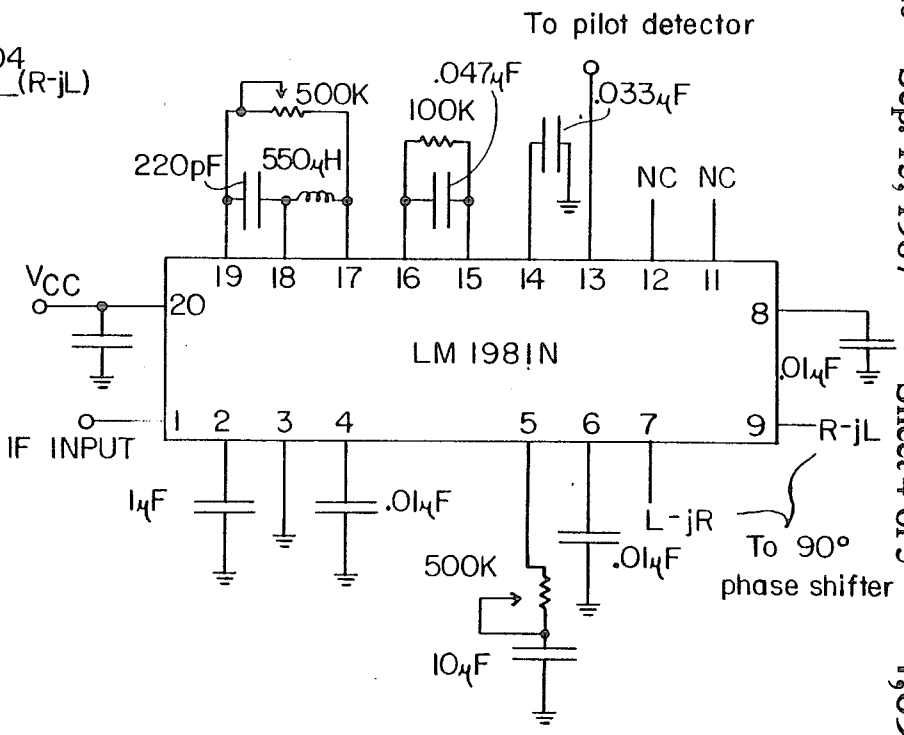
FIG. 7 is a schematic diagram of the stereo receiver of FIG. 5 using an LM1981N integrated circuit manufactured by National Semiconductor.

FIG. 7 illustrates how an LM1981N integrated circuit manufactured by National Semiconductor can be connected to perform the function of the circuit included in dotted line 426 of FIG. 5.

While the invention has been taught with regard to specific embodiments, those versed in the art will appreciate that changes can be made to detail without departing from the spirit and scope of the invention. For example, a different amplitude modulation detector could be used in the invention. Accordingly, all such changes come within the invention, as specifically claimed.

I claim:

1. A circuit for decoding an AM stereo signal comprising:

an input terminal adapted to receive an input signal having phase encoded and amplitude encoded information;

an AM detector coupled to said input terminal, said AM detector decoding said amplitude encoded information and providing an AM output signal on an AM output terminal indicative of said amplitude encoded information;

a PM detector coupled to said input terminal, said PM detector having a PM output terminal, said PM detector decoding said phase encoded information and providing a PM output signal on said PM output terminal indicative of said phase incoded information;

multiplying means for multiplying a first signal present on a first multiplier input times a second signal present on a second multiplier input, said first multiplier input being coupled to said PM output signal, said second multiplier input being coupled to said AM output terminal, said multiplying means placing the product of said first and second signals on a multiplier output terminal; and phase shifting means for shifting phases, said phase shifting means having a first phase input, a second phase input, a first phase output and a second phase output, said first phase input being coupled to said multiplier output terminal, said second phase input being coupled to said AM detector, said phase shifting means shifting the phase of the signal on said first phase input and providing the result on said first phase output, said phase shifting means shifting the phase of the signal on said second phase input and placing the result on said second phase output.

2. The circuit of claim 1 wherein said phase shifting means shifts the phase of the signal on said first phase input by −45° and said phase shifting means shifts the phase of the signal on said second phase shift input by +45°.

3. The circuit of claim 2 further comprising a matrix circuit having a first matrix input coupled to said first phase output and a second matrix input coupled to said second phase output, said matrix circuit adding the signals present on said first and second matrix inputs and providing the sum on a first matrix output, said matrix circuit subtracting the signal on the first matrix input from the signal present at said second matrix input and providing the result on a second matrix output.

4. A circuit for decoding an AM stereo broadcast comprising:

first means for providing a first signal corresponding to left plus right channel information shifted by a first phase angle;

second means for providing a second signal corresponding to left minus right channel information shifted by a second phase angle, the difference between said first and second phase angles being 90°;

first matrix means for providing a third signal equal to said first signal plus said second signal;

second matrix means for providing a fourth signal equal to said first signal minus said second signal;

first phase shift means for providing a fifth and a sixth signal, said fith signal being equal to said third signal shifted by a third phase angle, said sixth signal equal to said fourth signal shifted by said third phase angle plus 90°;

means for generating a left channel signal equal to the sum of said fifth and sixth signals;

second phase shift means for providing a seventh and eighth signal, said seventh signal being equal to said fourth signal plus a fourth phase angle, said eighth signal being equal to said third signal plus said fourth phase angle plus 90°; and means for generating a right channel signal equal to the sum of said seventh and eighth signals.

5. The circuit of claim 4 wherein said first means comprises an amplitude modulation detector.

6. The circuit of claim 4 wherein said second means comprises a phase modulation detector.

7. The circuit of claim 6 wherein said first means comprises a phase modulation detector and said second means comprises a multiplier, said multiplier having inputs coupled to said phase modulation and amplitude modulation detectors and an output coupled to said first and second matrix means.

* * * * *